US006750754B2

(12) United States Patent
Wang et al.

(10) Patent No.: US 6,750,754 B2
(45) Date of Patent: Jun. 15, 2004

(54) OVER-CURRENT PROTECTION APPARATUS

(75) Inventors: David Shau-Chew Wang, Taipei (TW); Chih-Ming Yu, Kaohsiung (TW); Yi-Nuo Chen, Taipei (TW)

(73) Assignee: Polytronics Technology Corporation, Hsinchu (TW)

( * ) Notice: Subject to any disclaimer, the term of this patent is extended or adjusted under 35 U.S.C. 154(b) by 0 days.

(21) Appl. No.: 10/429,657

(22) Filed: May 5, 2003

(65) Prior Publication Data

US 2004/0066270 A1 Apr. 8, 2004

(30) Foreign Application Priority Data

Oct. 8, 2002 (TW) ..... 91216030 U

(51) Int. Cl.[7] ..... H01C 7/10
(52) U.S. Cl. ..... 338/22 R; 338/23; 338/24
(58) Field of Search ..... 338/22 R, 22 SD, 338/23, 24

(56) References Cited

U.S. PATENT DOCUMENTS 3,686,857 A * 8/1972 Berg ..... 60/526
5,737,160 A 4/1998 Duffy
5,864,458 A 1/1999 Duffy et al.
5,907,272 A * 5/1999 McGuire ..... 338/22 R
5,945,903 A * 8/1999 Reddy et al. ..... 337/197
6,392,528 B1 * 5/2002 Myong ..... 338/22 R
6,606,023 B2 * 8/2003 Chiang et al. ..... 338/22 R
6,661,633 B1 * 12/2003 Furuta et al. ..... 361/103

* cited by examiner

*Primary Examiner*—Karl D. Easthom
(74) *Attorney, Agent, or Firm*—Seyfarth Shaw LLP

(57) ABSTRACT

The present invention reveals an over-current protection apparatus comprising a first electrode plate, a second electrode plate, a third electrode plate, a conductive element and a high resistance material layer, where the high resistance material layer may contact the first electrode plate to form a conducting path, the conductive element is connected to the first electrode plate and the second electrode, the thermally expanded conductive element can cut off current, the high resistance material layer is connected to the third electrode plate and the second electrode plate, and the thermal expansion coefficient of the high resistance layer is less than that of the conductive element. By virtue of the thermal expansion of the conductive element due to an over-current, the first electrode plate is departed from the third electrode plate so as to enforce the current flows through the high resistance material layer for current reduction. In addition, the heat generated from the high resistance material layer can be transferred to the conductive element to keep the conductive element expanded to cut off current.

10 Claims, 6 Drawing Sheets

OVER-CURRENT PROTECTION APPARATUS

BACKGROUND OF THE INVENTION (A) Field of the Invention

The present invention is related to an over-current protection apparatus, more specifically, to an over-current protection apparatus that can automatically cut off current.

(B) Description of Related Art

Electrical switches include manual switches, breakers, relays, etc. If an over-current occurs at the instance of a switch is being opened, an arcing may be generated at their contacts, i.e., a current exists until the arcing goes off. The arcing would damage the contacts, and the extent of the damage depends on the kind of DC or AC, and the amount of the current and the voltage. Therefore, the limitation of the current and the voltage applied on the contacts to prevent the contacts from being damaged is becoming a crucial point in practice.

The resistance of a positive temperature coefficient (PTC) conductive material is sensitive to temperature variation, which can be kept extremely low at normal operation due to its low sensitivity to temperature variance so that the circuit can operate normally. However, if an over-current or an over-temperature event occurs, the resistance will immediately increase to a high resistance state (e.g. above $10^4$ ohm.) Therefore, the over-current will be reversely eliminated and the objective to protect the circuit device can be achieved.

U.S. Pat. No. 5,737,160 and U.S. Pat. No. 5,864,458 both reveal the applications of a PTC element associated with switches. FIG. 1(*a*) and FIG. 1(*b*) respectively show the cases of the PTC element and the switches being connected in series and in parallel. Referring to FIG. 1(*a*), a PTC element 11 is connected with a switch 12 in series. When an over-current occurs, the resistance of the PTC element 11 will increase rapidly, reducing the current flowing in the circuit. Sequentially, the switch 12 is opened to avoid the damage of the PTC element 11 due to high voltage.

In FIG. 1(*b*), a PTC element 13 is connected with a switch 14 in parallel. The resistance of the PTC element 13 is higher than that of the switch 14, and thus only minor current flows through the PTC element 13. As a result, the resistance of the PTC element 13 is still low. When an over-current occurs, the switch 14 is being opened instantly to enforce current flow through the PTC element 13, so the resistance of the PTC element 13 ramps drastically whereby the current is reduced. Because a possible arcing of the switch 14 has to be taken into account, such kind of apparatus is attributed to apply for low voltage circuitry.

It is necessary to further provide a signal to control the switch 12 or 14 in association with a PTC element of the above over-current protection apparatuses. Basically, a PTC element does not function as a switch, but relies to connect with an extra switch to cut off the current. When the PTC element is tripped, the PTC element has to count on leakage current to keep the PTC element tripped for high resistance sustenance. Under the circumstances of high voltage and leakage current, the PTC element may be aged to lose its protection capability. In addition, if a false signal occurs, an unexpected damage may be induced.

SUMMARY OF THE INVENTION

The object of the present invention is to provide an over-current protection apparatus which can automatically cut off current to protect the protected circuitry, for the high voltage circuit device. Besides, the over-current protection apparatus can be mechanically reset and come back to its normal operation state.

The over-current protection apparatus of the present invention comprises a first electrode plate, a second electrode plate, a third electrode plate, a conductive element and a high resistance material layer. If no over-current occurs, the third electrode plate is electrically conductive to the first electrode plate to form a conducting path. The conductive element is connected to the first electrode plate and the second electrode plate. The high resistance material layer, whose thermal expansion coefficient is smaller than that of the conductive element, is connected to the third electrode plate and the second electrode plate. By virtue of the thermal expansion of the conductive element due to an over-current, the electrical conduction of first electrode plate and the third electrode plate is isolated to enforce the current flows through the high resistance material layer whereby the current is decreased.

The above mentioned over-current protection apparatus may further comprises a thermal conductive and electricity insulating layer to isolate the conductive element and the high resistance material layer, and to be a medium for heat transferring between them. Therefore, the expanded conductive element can be kept to isolate current.

The conductive element may comprise a PTC material, which is capable of thermal expansion.

Another over-current protection apparatus of the present invention comprises an insulating layer having a high thermal expansion coefficient, an upper electrode bar, a lower electrode bar, a first electrode terminal and a second electrode terminal, the upper electrode bar being attached to the insulating layer, the thermal expansion coefficient of the upper electrode bar being smaller than that of the insulating layer, the lower electrode bar being attached to the insulating as well, and the thermal expansion coefficient of the lower electrode bar being smaller than that of the insulating layer. The top of the lower electrode bar may contact the bottom of the upper electrode bar to form a conducting path, and the ends of the first electrode terminal and the second electrode terminal are respectively connected to the upper electrode bar and the lower electrode bar. The insulating layer is expanded by the heat generated from the over-current flowing through the upper electrode bar and the lower electrode bar, and thus the upper electrode bar and the lower electrode bar are dragged by the insulating layer to be separated to cut off current.

The insulating layer having a high thermal expansion coefficient may comprise polyethylene (PE), polypropylene (PP) or other crystallized polymers, and the upper electrode bar and the lower electrode bar may be made of copper, nickel, aluminum or other metals.

BRIEF DESCRIPTION OF THE DRAWINGS

FIG. 2(*b*) is the cross-sectional view of the line 1—1 of FIG. 2(*a*);

FIG. 2(*c*) illustrates the tripped over-current protection apparatus of is the first embodiment of the present invention;

FIG. 2(*d*) illustrates the circuitry of the over-current protection apparatus, in normal state, of the first embodiment of the present invention;

FIG. 2(*e*) illustrates the circuitry of the over-current protection apparatus, in tripped state, of the first embodiment of the present invention;

FIG. 3(*c*) and FIG. 3(*d*) respectively illustrate the circuitries in normal state and in tripped state of the second embodiment of the present invention;

FIG. 4(*b*) illustrates the cross-sectional view of the line 2—2 of FIG. 4(*a*);

FIG. 4(*c*) illustrates the circuitry of the over-current protection apparatus, in normal state, of the third embodiment of the present invention;

FIG. 4(*d*) illustrates the circuitry of the over-current protection apparatus, in tripped state, of the third embodiment of the present invention;

FIG. 5(*b*) illustrates the circuitry of the over-current protection apparatus, in tripped state, of the fourth embodiment of the present invention.

DETAILED DESCRIPTION OF THE INVENTION

Figure 1A:
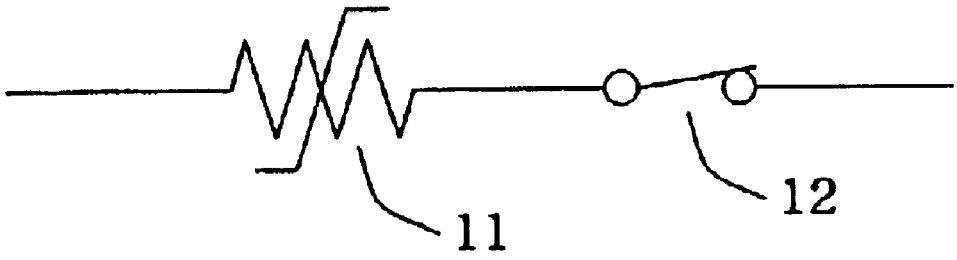
FIG. 1(a) (prior art)
FIG. 1(*a*) and FIG. 1(*b*) respectively illustrate known applications of a PTC element and a switch connected in series and in parallel.
Figure 1B:
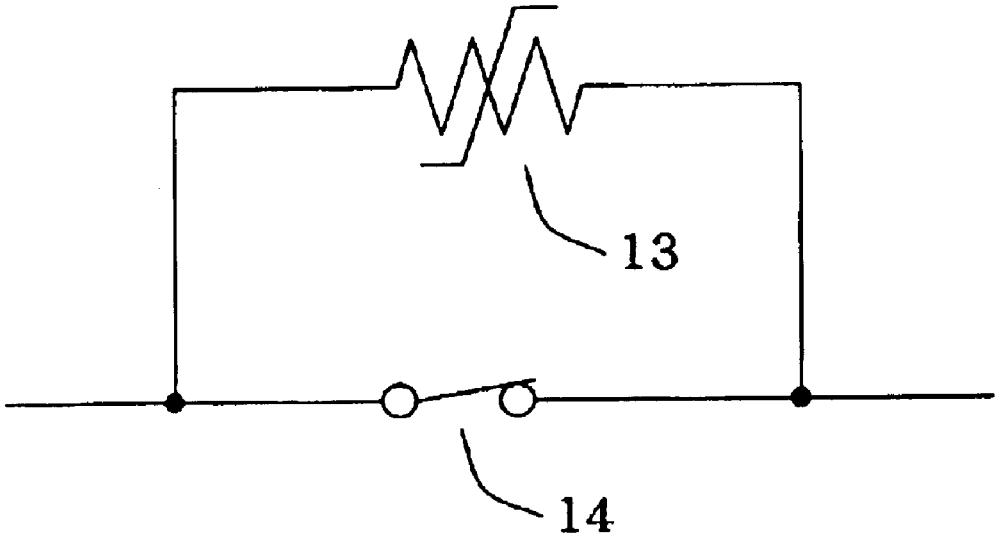
FIG. 1(b) (prior art)
Figure 2A:
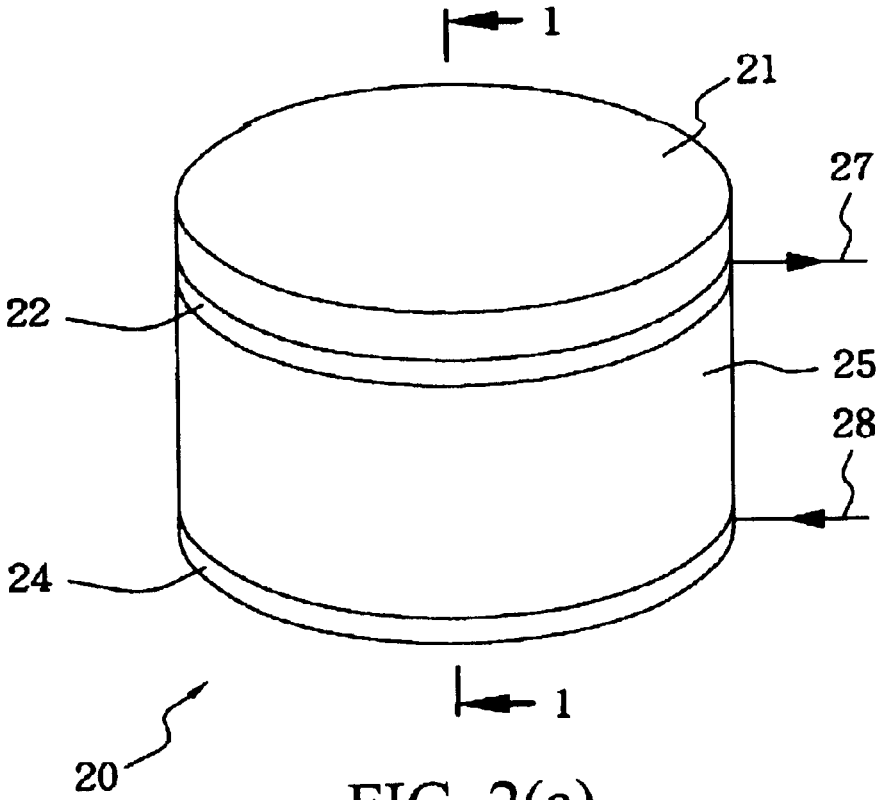
FIG. 2(*a*) illustrates the over-current protection apparatus of the first embodiment of the present invention.
Figure 2B:
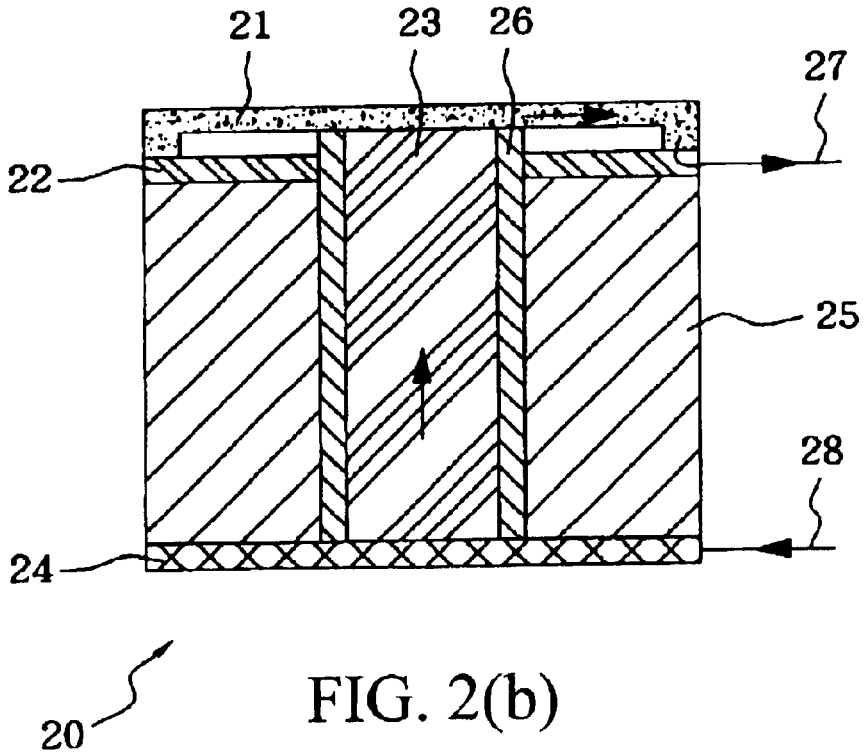
Figure 2C:
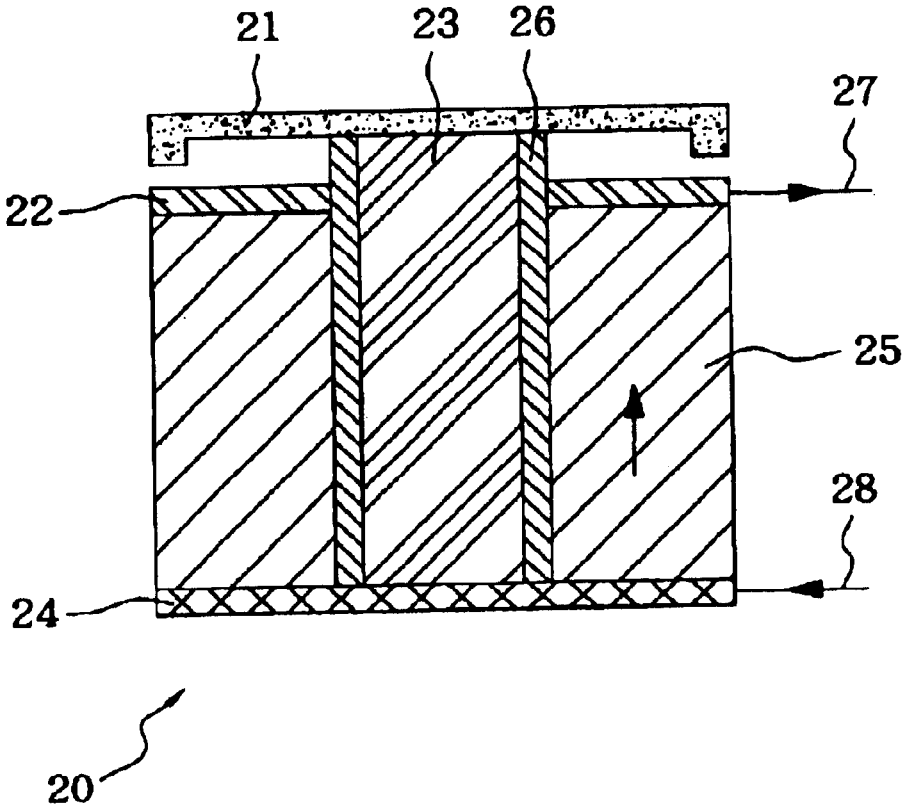
Figure 2D:
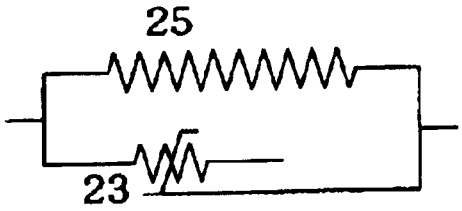
Figure 2E:
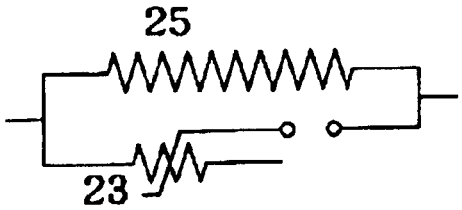
Figure 3A:
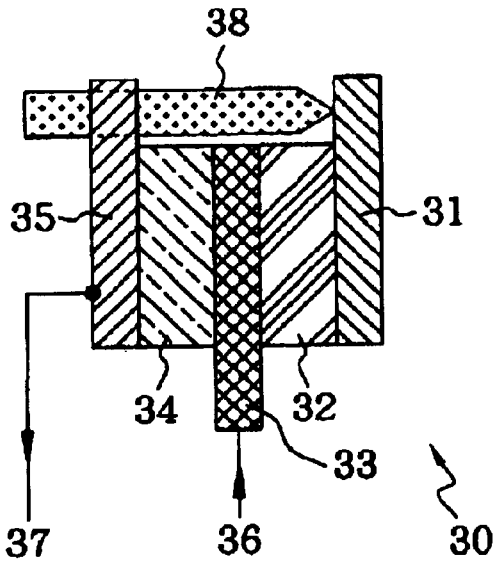
FIG. 3(*a*) and FIG. 3(*b*) respectively illustrate the over-current protection apparatus in normal state and in tripped state of the second embodiment of the present invention.
Figure 3B:
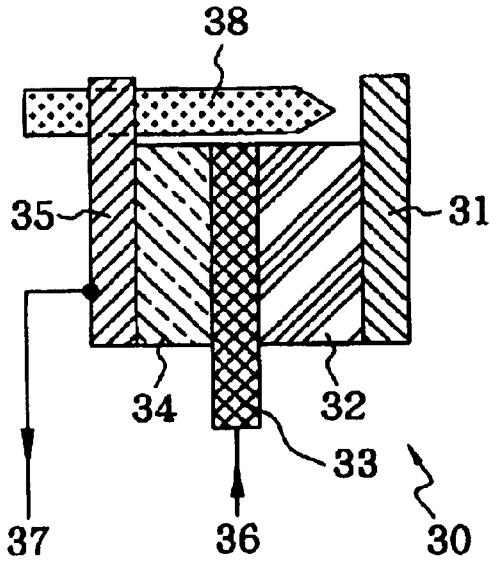
Figure 3C:
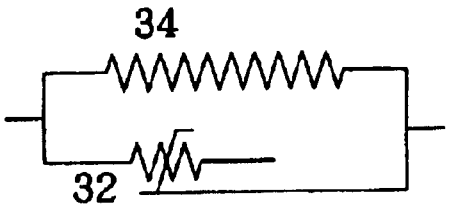
Figure 3D:
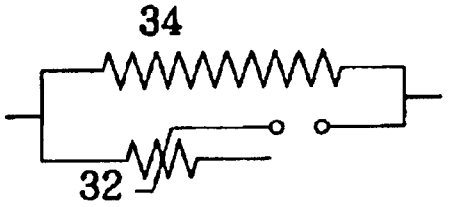
Figure 4A:
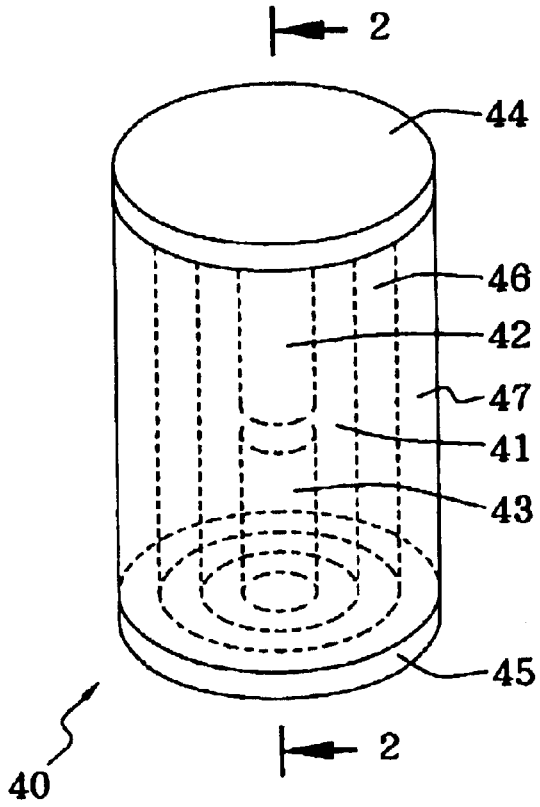
FIG. 4(*a*) illustrates the over-current protection apparatus of the third embodiment of the present invention.
Figure 4B:
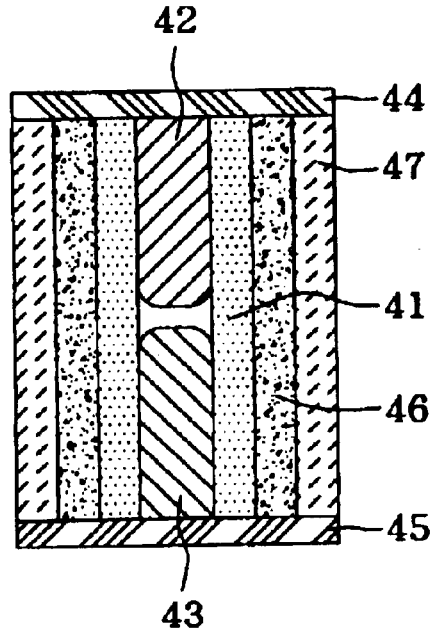
Figure 4C:
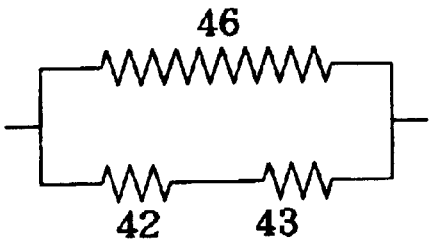
Figure 4D:
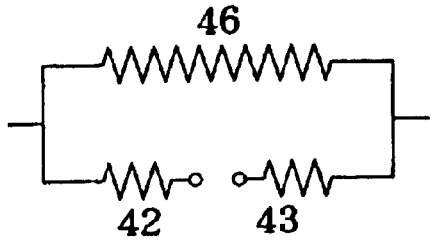

FIG. 2(*a*) illustrates the first embodiment of the over-current protection apparatus of the present invention, and FIG. 2(*b*) is the cross-sectional view of the line 1—1 of FIG. 2(*a*). An over-current protection apparatus 20 in the form of a cylinder comprises a first electrode plate 21, a second electrode plate 24, a PTC element 23, a third electrode plate 22, a high resistance material layer 25 and a thermal conductive and electricity insulating layer 26, where the first electrode plate 21 possesses a flange that may contact the third electrode plate 22 to constitute a conducting path, the third electrode plate 22 and the second electrode plate 24 are respectively connected to leads 27, 28 for connecting to a protected circuit device, the high resistance material layer 25 shaped as a pipe surrounds the PTC element 23, and may be made by a ceramic of approximately $10^4$ ohm, a PTC ceramic or graphite, and the thermal conductive and electricity insulating layer 26, placed between the high resistance material layer 25 and the PTC element 23, may be made by a heat conductive glue for both heat transfer and electrical isolation.

The over-current protection apparatus 20 in normal state, i.e., no over-current occurring, is shown in FIG. 2(*b*). Usually, the resistance of a PTC element is approximately 10 ohm, which is much smaller than that of the high resistance material layer 25, so current will flow through the lead 28, the second electrode plate 24, the PTC element 23, a first electrode plate 21, a third electrode plate 22 and the lead 27 as the path shown by the arrows of FIG. 2(*b*).

In FIG. 2(*c*), when an over-current occurs, the resistance of the PTC element 23 ramps up drastically, and the accompanying heat will induce the PTC element 23 to expand quickly. As a result, the first electrode plate 21 is lifted up and is departed from the third electrode plate 22, and thus the current changes the flowing path to go through the lead 28, the high resistance material layer 25 and the lead 27. Because of the high resistance value of the high resistance material layer 25, the current can be reduced rapidly. In the meantime, the heat generated by the current flowing through the high resistance material layer 25 is transferred to the PTC element 23 via the thermal conductive and electricity insulating layer 26, so the PTC element 23 will not be cooled down to recover the original shape as the current is cut off. In other words, the PTC element 23 is tripped by the over-current and maintains in the trip state by the heat generated from the high resistance material layer 25.

Because the over-current protection apparatus of the present invention employs the way of structural separation to cut off current, no leakage current flows through the PTC element 23. Furthermore, when the over-current flowing through the high resistance material layer 25 is gone, the heat generated from the high resistance material layer 25 is tremendously decreased as the current is lower or is cut off, and thus the PTC element 23 will be cooled down and shrunk back to its original position. As a result, the first electrode plate 21 and the third electrode plate 22 will be in contact again to rebuild a conducting path, i.e., capable of resetting.

FIG. 2(*d*) and FIG. 2(*e*) respectively illustrate the circuitries of the over-current protection apparatus 20 in normal state and in tripped state. In FIG. 2(*d*), the PTC element 23 and the high resistance material layer 25 are electrically connected in parallel. Because the resistance of the PTC element 23 is relatively low, the majority of current flows through the PTC element 23. In FIG. 2(*e*), when an over-current occurs, the resistance of the PTC element 23 ramps up rapidly, and the accompanying heat will induce the PTC element 23 to expand quickly to cut off the current. Therefore, the current is enforced to change the path to flow through the high resistance material layer 25.

FIG. 3(*a*) illustrates the over-current protection apparatus of the second embodiment of the present invention. An over-current protection apparatus 30 comprises a first electrode plate 31, a PTC element 32, a second electrode plate 33, a high resistance material layer 34, a third electrode plate 35 and a electrode bar 38, the second electrode plate 33 and the third electrode plate 35 are respectively connected to lead 36 and lead 37, one end of the electrode bar 38 being connected to the third electrode plate 35, and the other end of the electrode bar 38 contacting the first electrode plate 31. Referring to FIG. 3(*b*), similarly, the second embodiment employs the expandable PTC element 32 to separate the electrode bar 38 and the first electrode plate 31, i.e., the electrical conduction of the first electrode plate 31 and the third electrode plate 35 is isolated, so the current is enforced to flow through the high resistance material layer 34. In the meanwhile, the heat generated from the high resistance material layer 34 due to the flowing current is transferred to the PTC element 32 via the second electrode plate 33, and thus the expanded PTC element 32 can be sustained. Therefore, the electrode bar 38 is separated from the first electrode plate 31 to isolate the current, i.e., in tripped state. When the current flowing through the high resistance material layer 34 is gone, the heat generated from the high resistance material layer 34 is rapidly decreased as the current is lower or is cut off, and thus the PTC element 32 will be cooled and shrunk. Therefore, the electrode bar 38 and the first electrode plate 31 are recovered to be in contact, and thus the lead 36, the second electrode plate 33, the PTC element 32, the first plate 31, the electrode bar 38, the third electrode plate 35 and the lead 37 are in connection again to rebuild the conducting path, i.e., the over-current protection apparatus 30 is reset to have low resistance.

The PTC element 32, instead of being placed within the high resistance material layer 34, employs surface conduction to quickly transfer heat for obtaining quick response.

The tightness of the contact between the electrode bar 38 and the first electrode plate 31 can be fine tuned to reach the optimal performance.

The circuitries of the over-current protection apparatus 30 in normal state and in tripped state are respectively shown in FIG. 3(*c*) and FIG. 3(*d*). In FIG. 3(*c*), the PTC element 32 is connected to the high resistance material layer 34 in parallel. Because the PTC element 32 is of a relatively low resistance, the majority of current flows through the PTC element 32. Referring to FIG. 3(*d*), when an over-current occurs, the PTC element 32 will be expanded due to high temperature to cut off the current, and thus enforce the current to flow through the high resistance material layer 34.

The PTC element can be substituted by an expandable and temperature-sensitive material, which is described as follows.

FIG. 4(*a*) illustrates the over-current protection apparatus in tripped state of the third embodiment of the present invention, and FIG. 4(*b*) is the cross-sectional view of the line 2—2 of FIG. 4(*a*). An over-current protection apparatus 40 comprises an insulating layer 41 having a high thermal expansion coefficient, an upper electrode bar 42, a lower electrode bar 43, a high resistance material layer 46, an upper electrode terminal 44, a lower electrode terminal 45 and an insulating casing 47, the side walls of the upper electrode bar 42 and the lower electrode bar 43 are attached to the insulating layer 41, the upper electrode bar 42 and the lower electrode bar 43 are electrically connected as an over-current does not occur, the high resistance material layer 46 respectively connected to the upper electrode terminal 44 and the lower electrode terminal 45 is electrically connected with the upper electrode bar 42 and the lower electrode bar 43 in parallel, and the insulating layer 41 shaped as a pipe surrounds the upper electrode bar 42 and the lower electrode bar 43. The insulating layer 41 may be made by insulating materials having thermal expansion capability such as polyethylene (PE), polypropylene (PP). The high resistance material layer 46, which may be made by a ceramic, a ceramic PTC or graphite, is electrically connected to the upper electrode terminal 44 and the lower electrode terminal 45. The upper electrode bar 42 and the lower electrode bar 43 may be made by a ceramic, a conductive polymer or metals such as copper, aluminum and nickel. When an over-current occurs, because the thermal expansion coefficient of PE or PP is much greater than that of the electrode bars, the upper electrode bar 42 and the lower electrode bar 43 will be dragged by the insulating layer 41 to be separated so as to cut off the current. As a result, the current is forced to completely flow through the upper electrode terminal 44, the high resistance material layer 46 and the lower electrode terminal 45. Because the high resistance of the layer 46, the current can be decreased quickly. In the meantime, the heat generated from the high resistance material layer 46 is transferred to the insulating layer 41, so the expanded insulating layer 41 can be kept, i.e., the upper electrode bar 42 and the lower electrode bar 43 are separated to cut off the current. When the current flowing through the high resistance material layer 46 is gone, the heat generated from the high resistance material layer 46 is tremendously decreased as the current is lower or is cut off, and thus the insulating layer 41 having high thermal expansion coefficient will be cooled and shrunk. Therefore, the upper electrode bar 42 and the lower electrode bar 43 are recovered to be in contact again, and thus the upper electrode terminal 44, the upper electrode bar 42, the lower electrode bar 43 and the lower electrode terminal 45 are connected again to rebuild the conducting path, i.e., the over-current protection apparatus 40 is reset to have low resistance.

FIG. 4(*c*) illustrates the circuitry of the over-current protection apparatus 40 in normal state. The upper electrode bar 42 and the lower electrode bar 43 are electrically connected to the high resistance material layer 46 in parallel. Because the upper electrode bar 42 and the lower electrode bar 43 are of relatively low resistance, the majority of current will flow through the electrode bars 42 and 43. FIG. 4(*d*) illustrates the circuitry of the over-current protection apparatus 40 in tripped state. When an over-current occurs, the upper electrode bar 42 and the lower electrode bar 43 are separated due to the accompanying higher temperature, enforcing the current to flow through the high resistance material layer 46.

Figure 5A:
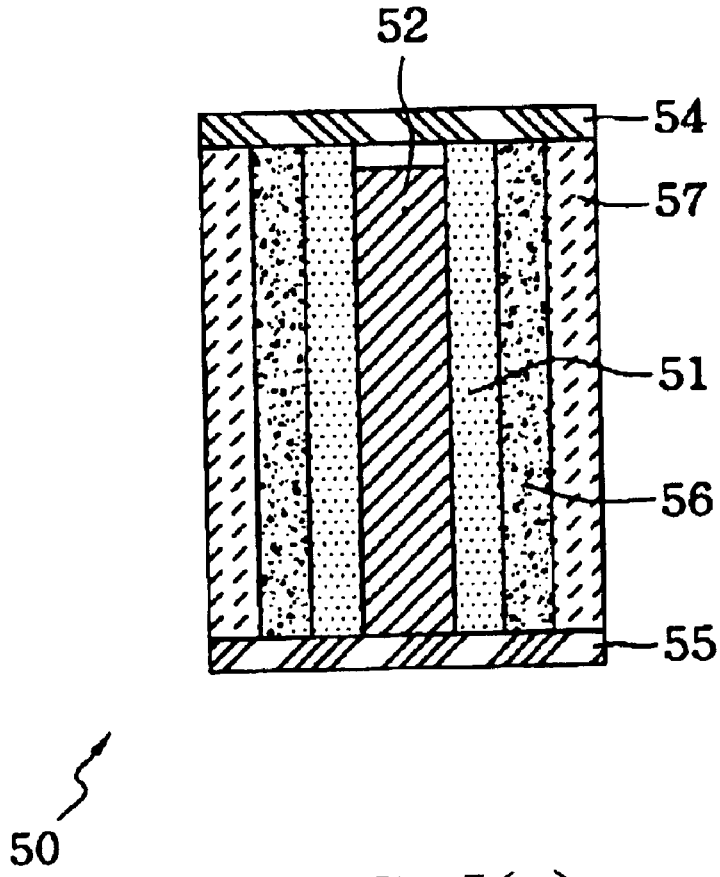
FIG. 5(*a*) illustrates the over-current protection apparatus of the fourth embodiment of the present invention.
Figure 5B:
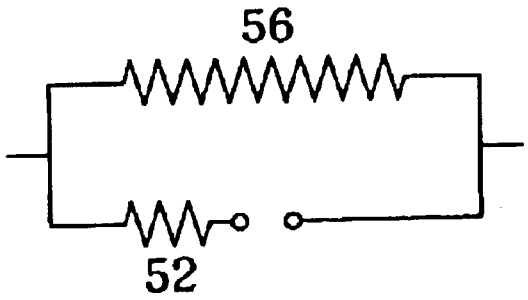

The upper electrode bar 42 and the lower electrode bar 43 can be substituted by a single rod as shown in FIG. 5(*a*), which shows the over-current protection apparatus, in tripped state, of the fourth embodiment. An over-current protection apparatus 50 comprises an insulating layer 51 of a high thermal expansion coefficient, an electrode rod 52, a high resistance material layer 56, an upper electrode terminal 54, a lower electrode 55 and an insulating casing 57. FIG. 5(*b*) illustrates the circuitry of the over-current protection apparatus 50 in tripped state, and that the electrode rod 52 is separated from the upper electrode terminal 54, inducing the current flows through the high resistance material layer 56.

Theoretically, the above mentioned over-current protection apparatuses use a resistor of high resistance and a resistor capable of resetting connected in parallel to cut off current. The present invention uses structural separation to ensure no leakage current flows through the resistor capable of resetting, and the heat generated from the resistor of high resistance to keep the resistor tripped. Therefore, the concern of insufficient endurance of the resistor capable of resetting can be ignored, so the over-current protection apparatus can be applied for high voltage work, e.g., household appliance used 100 or 110 volts, or the device used 600–700 volts or higher volts.

The present invention can also connect a plurality of apparatuses in series and/or in parallel to obtain the required electrical performance to avoid the damage cause by an over-current or an over-voltage.

The above-described embodiments of the present invention are intended to be illustrative only. Numerous alternative embodiments may be devised by those skilled in the art without departing from the scope of the following claims.

What is claimed is:

1. An over-current protection apparatus, comprising:

a first electrode plate;

a second electrode plate;

a third electrode plate electrically connected to the first electrode plate when no over-current occurs;

a PTC element connected to the first electrode plate and the second electrode plate; and a high resistance material layer connected to the second electrode plate and the third electrode plate, and the thermal expansion coefficient of the high resistance material layer being smaller than that of the PTC element;

whereby the thermal expansion of the PTC element caused by an over-current isolates the electrical connection between the first electrode plate and the third electrode plate, the current will flow through the high resistance material layer and is reduced thereby.

2. The over-current protection apparatus of claim 1, wherein the heat generated from the high resistance material layer can keep the PTC element in a high thermal expansion state.

3. The over-current protection apparatus of claim 1, wherein the first electrode plate comprises a flange in order to electrically contact the third electrode plate.

4. The over-current protection apparatus of claim 2, which can be reset via mechanically cut off the current.

5. The over-current protection apparatus of claim 1, wherein the high resistance material layer is selected from the group consisting of a ceramic, ceramic PTC and graphite.

6. The over-current protection apparatus of claim 1, further comprising a thermal conductive and electricity insulating layer for isolating the PTC element and the high resistance material layer.

7. The over-current protection apparatus of claim 6, wherein the thermal conductive and electricity insulating layer is made of a heat conductive glue.

8. The over-current protection apparatus of claim 1, wherein the high resistance material layer is shaped like a pipe and surrounds the PTC element.

9. The over-current protection apparatus of claim 1, which is applied for a circuit connecting to a voltage source between 100 to 700 volts.

10. The over-current protection apparatus of claim 1, further comprising an electrode bar, one end of the electrode bar being connected to the third electrode plate, and the other end of the electrode bar electrically contacting the first electrode plate when no over-current occurs for electrically connecting the third electrode plate and the first electrode plate.

* * * * *